US006647966B2

(12) United States Patent
Tian et al.

(10) Patent No.: US 6,647,966 B2
(45) Date of Patent: Nov. 18, 2003

(54) COMMON RAIL FUEL INJECTION SYSTEM AND FUEL INJECTOR FOR SAME

(75) Inventors: Ye Tian, Bloomington, IL (US); Xinshuang Nan, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/960,772

(22) Filed: Sep. 21, 2001

(65) Prior Publication Data

US 2003/0056757 A1 Mar. 27, 2003

(51) Int. Cl.[7] ..... F02M 37/04
(52) U.S. Cl. ..... 123/467; 123/496
(58) Field of Search ..... 123/496, 467, 123/506, 500, 501, 446; 239/88–96, 533.2

(56) References Cited

U.S. PATENT DOCUMENTS

| | | | | |
|---|---|---|---|---|
| 3,680,782 A | | 8/1972 | Monpetit et al. | |
| 4,175,587 A | | 11/1979 | Chadwick et al. | |
| 4,297,982 A | | 11/1981 | Lakra | |
| 4,385,339 A | | 5/1983 | Takada et al. | |
| 4,838,233 A | | 6/1989 | Hayashi et al. | |
| 5,082,180 A | | 1/1992 | Kubo et al. | |
| 5,156,132 A | * | 10/1992 | Iwanaga | 123/496 |
| 5,343,845 A | | 9/1994 | Fehlmann | |
| 5,647,536 A | | 7/1997 | Yen et al. | |
| 5,660,331 A | | 8/1997 | Cooke | |
| 5,664,545 A | | 9/1997 | Kato et al. | |
| 5,758,622 A | | 6/1998 | Rembold et al. | |
| 5,915,361 A | * | 6/1999 | Heinz et al. | |
| 6,113,000 A | | 9/2000 | Tian | |
| 6,168,132 B1 | * | 1/2001 | Frank et al. | 251/33 |
| 6,328,017 B1 | * | 12/2001 | Heinz et al. | 123/467 |
| 6,367,453 B1 | * | 4/2002 | Igashira et al. | 123/467 |
| 6,439,193 B2 | * | 8/2002 | Lehtonen | 123/299 |

FOREIGN PATENT DOCUMENTS

WO WO 00/23704 4/2000

OTHER PUBLICATIONS

M. Brezonick, Lucasvarity's New Common Rail System, 4 pp., Diesel Progress (30–34), Oct. 1998, USA.

N. Guerrassi and P. Dupraz, A Common Rail Injection System for High Speed Direct Injection Diesel Engines, 9 pp., SAE 980803, Feb. 1998, Detroit, Michigan, USA.

U. Flaig, W. Polach and G. Ziegler, Common Rail System (CR–System) for Passenger Car DI Disel Engines; Experiences With Applications for Series Production Projects, 12 pp., SAE 1999–01–0191, Detroit, Michigan, USA.

Bernd Mahr, Manfred Dürnholz, Wilhelm Polach, and Hermann Grieshaber, Robert Bosch GmbH, Heavy Duty Diesel Engines—The Potential of Injection Rate Shaping for Optimizing Emissions and Fuel Consumption Stuttgart, Germany, at the 21st International Engine Symposium, May 4–5, 2000, Vienna, Austria.

* cited by examiner

*Primary Examiner*—Carl S. Miller
(74) *Attorney, Agent, or Firm*—Liell & McNeil

(57) ABSTRACT

A fuel injection system is provided which includes a source of high pressure fuel, a low pressure fuel reservoir, and at least one fuel injector which has an injector body that defines a nozzle chamber, a needle control chamber, a needle control vent, a fuel inlet, and a nozzle outlet. A high pressure line extends between the source of high pressure fuel and the fuel inlet. A low pressure line extends between the low pressure fuel reservoir and the needle control vent. A needle control valve is positioned in the injector body and includes a poppet valve member with a first position in which the needle control chamber is fluidly connected to the fuel inlet but closed to the needle control vent. The poppet valve also has a second position in which the needle control chamber is closed to the fuel inlet but open to the needle control vent. A needle valve is positioned in the injector body and includes a one piece needle valve member with a closing hydraulic surface exposed to fluid pressure in the needle control chamber, and an opening hydraulic surface exposed to fluid pressure in the nozzle chamber.

10 Claims, 2 Drawing Sheets

COMMON RAIL FUEL INJECTION SYSTEM AND FUEL INJECTOR FOR SAME

TECHNICAL FIELD

The present invention relates generally to fuel injectors, and more particularly to common rail systems with a three way control valve.

BACKGROUND

Common rail fuel injection systems offer an efficient, relatively simple means for pressurizing and injecting fuel in an internal combustion engine. These systems use a single pump to pressurize fuel, which is transferred to a common rail, from where it is distributed to the fuel injectors. Some of these systems not only inject diesel fuel, but also use fuel to directly control the opening and closing of valves within the injectors. One example of such a design is found in the BOSCH APCRS fuel system. Which is described in "Heavy Duty Diesel Engines—The Potential of Injection Rate Shaping for Optimizing Emissions and Fuel Consumption", presented by Messrs. Bernd Mahr, Manfred Dürnholz, Wilhelm Polach, and Hermann Grieshaber, Robert Bosch GmbH, Stuttgart, Germany, at the 21st International Engine Symposium, May 4–5, 2000, Vienna, Austria. The BOSCH system uses a medium pressure rail and a lift controlled injector with local intensification. Although the BOSCH APCRS and other common rail systems appear to function adequately, there is always room for improvement.

For example, the continuous fuel leakage during an injection causes a significant wastage of power. Engine power devoted to pressurizing fuel is wasted if high pressure fuel leaks out of the injector, reducing fuel efficiency. A further limitation is inherent in the manufacturing process used to make the BOSCH injectors. Because these injectors use several very small flow control orifices, they must be meticulously machined.

The present invention is directed to solving one or more of the problems or limitations set forth above.

SUMMARY OF THE INVENTION

A fuel injector is provided which includes an injector body defining a needle control chamber, a needle control vent, a nozzle chamber, a fuel inlet, and a nozzle outlet. A needle control valve is positioned in the injector body and includes a poppet control valve member. The poppet control valve member has a first position in which the needle control chamber is fluidly connected to the fuel inlet, but closed to the needle control vent, and a second position in which the needle control chamber is closed to the fuel inlet but open to the needle control vent. A needle valve member includes a closing hydraulic surface exposed to fluid pressure in the needle control chamber and an opening hydraulic surface exposed to fluid pressure in the nozzle chamber.

In another aspect, a fuel injection system is provided which includes a source of high pressure fuel, a low pressure fuel reservoir, and at least one fuel injector which has an injector body that defines a nozzle chamber, a needle control chamber, a needle control vent, a fuel inlet, and a nozzle outlet. A high pressure line extends between the source of high pressure fuel and the fuel inlet. A low pressure line extends between the low pressure fuel reservoir and the needle control vent. A needle control valve is positioned in the injector body and includes a poppet control valve member with a first position in which the needle control chamber is fluidly connected to the fuel inlet but closed to the needle control vent. The poppet control valve member also has a second position in which the needle control chamber is closed to the fuel inlet but open to the needle control vent. A needle valve member is positioned in the injector body and includes a closing hydraulic surface exposed to fluid pressure in the needle control chamber, and an opening hydraulic surface exposed to fluid pressure in the nozzle chamber.

In still another aspect, the present invention includes a method of injecting fuel which includes the step of relieving pressure on a closing hydraulic surface of a needle valve member. This is achieved at least in part by moving a poppet control valve member to a position that closes fluid communication between a common fuel rail and a needle control chamber. The method also includes the step of resuming pressure on the closing hydraulic surface at least in part by moving the poppet control valve member to a position that opens fluid communication between a common fuel rail and the needle control chamber.

DETAILED DESCRIPTION

Figure 1:
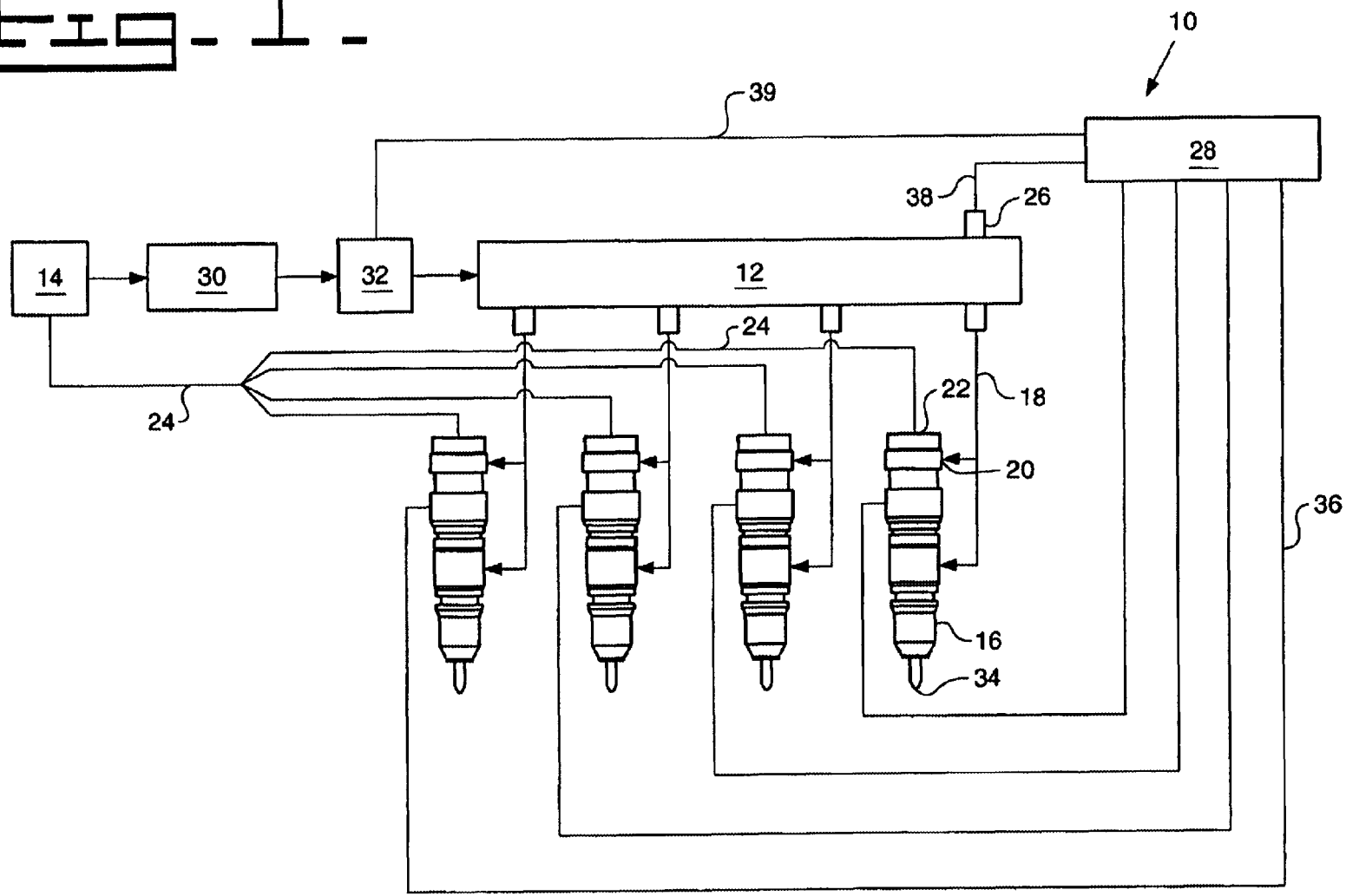
FIG. 1 is a system level schematic diagram of a fuel injection system according to the present invention.

Referring now to FIG. 1, there is shown a schematic diagram representing a fuel injection system 10 according to the present invention. Injection system 10 is controlled by an electronic control module 28 and includes a source of high pressure fuel 12, which is preferably a common rail, a low pressure fuel reservoir 14, which is preferably the engine fuel tank, and a plurality of fuel injectors 16. A low pressure gear pump 30 supplies fuel from low pressure reservoir 14 to a high pressure pump 32 which pressurizes fuel and supplies it to common rail 12. From common rail 12, a separate high pressure line 18 extends to each of the fuel injectors 16, entering the injector via a fuel inlet 20. The high pressure fuel is used in each injector 16 to directly control fuel injection, and is itself injected through a nozzle outlet 34 into the combustion space. Pressurized fuel used to directly control injection can be vented via a needle control vent 22 to a low pressure vent line 24 that fluidly connects to low pressure reservoir 14.

A pressure sensor 26 is attached to common rail 16 and communicates the rail pressure to the electronic control module 28 via a pressure sensor communication line 38. Electronic control module 28 controls high pressure pump 32 via a pump communication line 39, and can thus precisely control the pressure in common rail 12 in a conventional manner. Electronic control module 28 also controls the action of each fuel injector 16 in a conventional manner via a plurality of injector communication lines 36.

Figure 2:
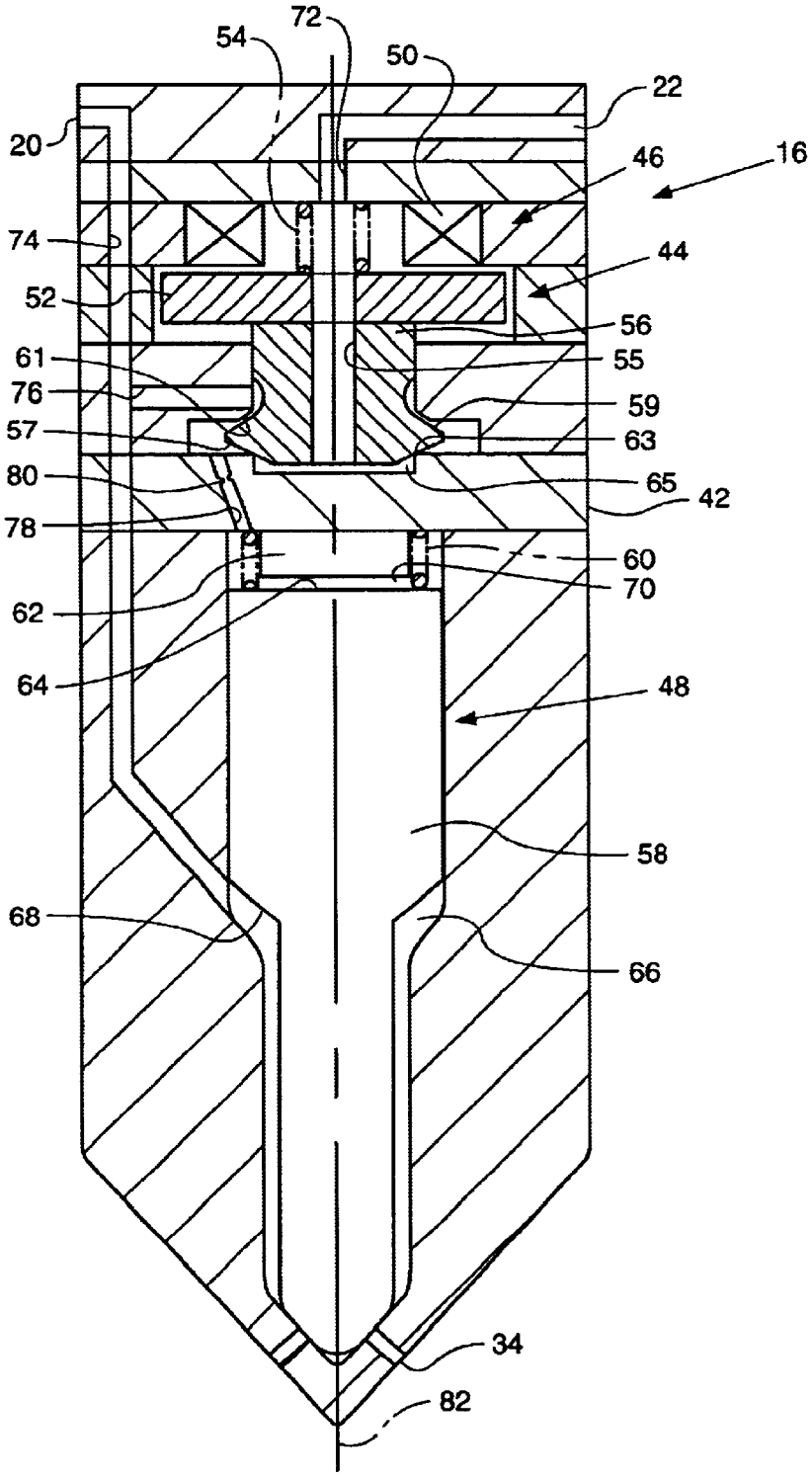
FIG. 2 is a sectioned side diagrammatic view of a fuel injector according to the present invention.

Referring to FIG. 2, there is shown a sectioned side diagrammatic view of the preferred fuel injector 16 of injection system 10 from FIG. 1. Injector 16 has an injector body 42 which defines a nozzle chamber 66, a needle control chamber 70, needle control vent 22, fuel inlet 20, and nozzle outlet 34. A needle control valve 44 and needle valve 48 are positioned within injector body 42.

Needle control valve 44 consists of an electrical actuator 46 and a poppet valve member 56. Electrical actuator 46 is preferably positioned within injector body 42 and includes a coil 50 and armature 52 that is attached to poppet control valve member 56. Although electrical actuator 46 is preferably a solenoid 46, it should be appreciated that some other suitable device such as a piezoelectric actuator might be used without departing from the intended scope of the present invention. Similarly, electrical actuator 46 might be positioned remote from injector body 42 rather than within it. However, valve member 56 is preferably positioned as close as possible to needle control chamber 70 in order to reduce the fluid volume above needle 48.

Energizing and de-energizing solenoid 46 moves valve member 56 between a first and a second position. When solenoid 46 is de-energized, a biasing spring 54 biases armature 52 and hence control valve member 56 toward valve member 56's first position in which an external first annular surface 57 of valve member 56 is in contact with a low pressure seat 63, blocking fluid flow around the seat 63. When control valve member 56 is in this position, fluid can flow from a branch passage 76, defined by valve body 42, around valve member 56 and past a high pressure seat 61, and fluidly connect to a pressure communication passage 78. Branch passage 76 connects to fuel inlet 20 via a high pressure passage 74, thus providing high pressure fuel to pressure communication passage 78 when solenoid 46 is de-energized.

When solenoid 46 is energized, it moves armature 52 and poppet valve member 56 up to a second position in which a second annular surface 59 of valve member 56 comes in contact with high pressure seat 61, blocking fluid flow around the seat 61. An interior bore 55 through valve member 56 provides fluid communication via a vent passage 72 between needle control vent 22 and a cavity 65 under valve member 56. When poppet control valve member 56 is in this second position, fluid can flow past low pressure seat 63 such that cavity 65 is fluidly connected to pressure communication passage 78. Consequently, pressure in pressure communication passage 78 can be vented through needle control vent 22 when solenoid 46 is energized. When valve member 56 has opened low pressure seat 63, but not yet closed high pressure seat 61, high pressure fluid from branch passage 76 can briefly spill into cavity 65, through interior bore 55 and out through needle control vent 22. Because the leakage of pressurized fluid wastes energy, it is desirable to minimize the time during which branch passage 76 is open to needle control vent 22. Reducing the travel distance of valve member 56 reduces this time period. In the preferred embodiment, the distance valve member 56 travels between its first and second positions is preferably less than about 50 microns.

Pressure communication passage 78 is connected to a needle control chamber 70, in which varying fluid pressure from pressure communication passage 78 controls the state of needle valve 48. In the preferred embodiment, needle valve 48 is positioned between fuel inlet 20 and nozzle outlet 34 along a centerline 82. Needle valve 48 includes a valve member 58, which is preferably a one piece valve member, and is movable between an open position in which nozzle outlet 34 is open, and a closed position in which nozzle outlet 34 is shut. Valve member 58 has an opening hydraulic surface 68 exposed to fluid pressure in a nozzle chamber 66 which fluidly connects to fuel inlet 20 via high pressure passage 74. Needle valve member 58 also has a closing hydraulic surface 64 exposed to fluid pressure in needle control chamber 70. When solenoid 46 is de-energized, high pressure is thus provided via pressure communication passage 78 to needle control chamber 70, and also to nozzle chamber 66 from high pressure passage 74. A biasing spring 60 biases needle valve member 58 toward its closed position, holding nozzle outlet 34 shut.

When solenoid 46 is energized, and high pressure in needle control chamber 70 is vented, the hydraulic force on valve member 58's opening hydraulic surface 68 can overcome the force of biasing spring 60 to lift needle valve member 58 and open nozzle outlet 34. The relative sizes of hydraulic surfaces 68 and 64, and the strength of biasing spring 60 should be such that needle valve member 58 moves toward or holds nozzle outlet 34 shut when high pressure prevails in needle control chamber 70, but will allow needle valve member 56 to open nozzle outlet 34 when the pressure in needle control chamber 70 is vented. In the preferred embodiment, a stop 62 is positioned in needle control chamber 70 which defines the travel distance of needle valve member 58 and reduces the volume of fluid in needle control chamber 70. By reducing the fluid volume in needle control chamber 70, the quantity of fluid transfer necessary to induce the increases and decreases in pressure in needle control chamber 70 can be reduced, resulting in faster response times for needle valve member 58. Consequently, faster needle response times are possible, resulting in greater precision in the control over initiation and termination of fuel injection.

In the preferred embodiment, the space between surfaces 57 and seat 63, defines a first flow area, and pressure communication passage 78 defines a second flow area 80. Flow area 80 is preferably a flow restriction area 80 within pressure communication passage 78, and should be sized such that it is more restrictive than the first flow area past poppet valve member 56 between surface 57 and seat 63. The first flow area preferably has a size that is a function of a combined volume of the needle control chamber 70 and the pressure communication passage 78, which should be less than about 50 cubic millimeters. The motivation is to reduce the volume of fluid bounded by valve member 56 and needle valve member 58. This is because the larger the volume, the longer it takes to build and/or relieve pressure in that volume, due at least in part to the bulk modulus of the fluid. In the case of the high and low pressures within a fuel injector, fluid flow volume on the order of 10% of the total volume must pass the valve in order to compress the fluid and bring it up to pressure. Sizing flow restriction area 80 to be less than the flow area past valve member 56 desensitizes the system performance to inevitable variations in needle control valve assemblies from one injector to another due to such factors as machining tolerances.

Industrial Applicability

Referring now to FIG. 2, there is shown a fuel injector 16 according to the present invention with its components in the positions they would occupy just prior to the start of an injection event. Solenoid 46 is de-energized and poppet valve member 56 is in its first position, closing low pressure seat 63. High pressure prevails in needle control chamber 70 and nozzle chamber 66. The hydraulic force on closing hydraulic surface 64, and the force of biasing spring 60 hold needle valve member 58 down, shutting nozzle outlet 34.

When an injection event is desired, current is supplied to solenoid 46. Armature 52 and valve member 56 are pulled upward, moving valve member 56 to its second position. As low pressure seat 63 is opened, pressure communication passage 78 and hence needle control chamber 70 become fluidly connected via low pressure vent 22 to low pressure reservoir 14. As valve member 56 closes high pressure seat 61, the pressure in needle control chamber 70 drops quickly, as does the force on closing hydraulic surface 64. The high pressure acting on opening hydraulic surface 68 in nozzle chamber 66 moves needle valve member 58 up, opening nozzle outlet 34 and allowing fuel to spray into the combustion space.

When termination of an injection event is desired, current to solenoid 46 is stopped. Armature 52 and hence valve member 56 move down, opening high pressure seat 61 and quickly closing low pressure seat 63. Needle control vent 22 is blocked from fluid communication with pressure communication passage 78, and high pressure fluid from high pressure passage 74 via branch passage 76 can flow around high pressure seat 61, and through pressure communication passage 78 to quickly raise the pressure in needle control chamber 70. The return of high pressure to needle control chamber 70, and the force of biasing spring 60 can force needle valve member 58 down to close nozzle outlet 34, ending injection.

The present invention represents an improvement over earlier common rail designs. For instance, rather than continuously leaking pressurized fuel from a common rail during an injection event, the present invention shuts off the supply of pressurized fuel from the common rail 16 during an injection event. Similarly, designing the needle control valve 44 to operate within a distance of less than about 50 microns significantly lessens the amount of time during which the valve member 56 is between the high pressure seat 61 and the low pressure seat 63, leaking fuel to vent 22. Less engine power is wasted pressurizing fuel that would be subsequently leaked back to the low pressure reservoir 14 without serving any purpose. The result is an increase in overall fuel efficiency. Additionally, restricting the flow areas in the manner described de-sensitizes the system to valve geometry variations due to manufacturing tolerances. Furthermore, by reducing the volume of hydraulic fluid above closing hydraulic surface 64 that must be transferred in directly controlling needle valve member 58, faster valve speeds are attained, ultimately improving the control over injection initiation and termination. The preferred design procedure begins by implementing strategies that will reduce the fluid volume of needle control chamber 70 and passage 78. This is initially accomplished by positioning needle control valve as close as possible to needle control chamber 70. Next, a stop piece 62 is chosen to be of a size to occupy most of the volume of chamber 70. Once the available fluid volume of chamber 70 is determined, the valve member 56 and its travel distance can be determined to provide adequate flow. Next, a flow restriction 80 is placed in passage 78 to desensitize performance to inevitable variations in valve geometry's due to such factors as manufacturing tolerances.

It should be appreciated that the present description is intended for illustrative purposes only and is not intended to limit the scope of the present invention in any way. For example, rather than positioning electrical actuator 46 within the injector body 42, it might be positioned remote from the injector body 42. A hydraulic biasing means for control valve 44 might be employed rather than a biasing spring. The hydraulic surfaces 64 and 68 of needle valve member 58 might be sized such that needle biasing spring 60 might also be dispensed with. In addition, those skilled in the art will appreciate that the principles of the present invention, especially those relating to flow areas, fluid volumes and usage of a poppet control valve member, could be applied to other direct control fuel injectors including but not limited to hydraulically actuated and mechanically actuated vait injectors. Thus, those skilled in the art will appreciate that various modifications could be made to the disclosed embodiments without departing from the intended scope of the present invention. Other aspects and features of the present invention can be obtained from a study of the drawings, the disclosure, and the appended claims.

What is claimed is:

1. A fuel injector comprising:

an injector body defining a nozzle chamber, a needle control chamber, a needle control vent, a fuel inlet and a nozzle outlet;

a needle control valve positioned in said injector body and including a poppet control valve member having a first position in which said needle control chamber is fluidly connected to said fuel inlet but closed to said needle control vent, and a second position in which said needle control chamber is closed to said fuel inlet but open to said needle control vent;

a needle valve member positioned in said injector body and including a closing hydraulic surface exposed to fluid pressure in said needle control chamber and an opening hydraulic surface exposed to fluid pressure in said nozzle chamber;

said needle control valve defines a first flow area;

a pressure communication passage extending between said needle control valve and said needle control chamber defines a second flow area that is smaller than said first flow area; and said first flow area has a size that is a function of a combined volume of said needle control chamber and said pressure communication passage.

2. The fuel injector of claim 1 wherein said poppet control valve member is a poppet valve member with an external surface with a first annular valve surface and a second annular valve surface.

3. The fuel injector of claim 2 wherein said poppet valve member moves a travel distance between said first position and said second position, and said travel distance is less than about 50 microns.

4. The fuel injector of claim 1 including an electrical actuator positioned in said injector body and being operably coupled to said needle control valve.

5. The fuel injector of claim 4 wherein said electrical actuator is a solenoid with an armature attached to said poppet control valve member.

6. The fuel injector of claim 1 wherein said injector body has a centerline; and said needle valve is positioned between said fuel inlet and said nozzle outlet along said centerline.

7. A fuel injector comprising:

an injector body defining a nozzle chamber, a needle control chamber, a needle control vent, a fuel inlet and a nozzle outlet;

a needle control valve positioned in said injector body and including a poppet control valve member having a first position in which said needle control chamber is fluidly connected to said fuel inlet but closed to said needle control vent, and a second position in which said needle control chamber is closed to said fuel inlet but open to said needle control vent;

a needle valve member positioned in said injector body and including a closing hydraulic surface exposed to fluid pressure in said needle control chamber and an opening hydraulic surface exposed to fluid pressure in said nozzle chamber;

said injector body defines a pressure communication passage extending between said needle control valve and said needle control chamber; and a combined volume of said pressure communication passage and said needle control chamber is less than about 50 cubic millimeters.

8. A fuel injection system comprising:

a source of high pressure fuel;

a low pressure fuel reservoir;

a plurality of fuel injectors each having an injector body defining a nozzle chamber, a needle control chamber, a needle control vent, a fuel inlet and a nozzle outlet;

a high pressure line extending between said source of high pressure said fuel inlet;

a low pressure vent line extending between said low pressure fuel reservoir and said needle control vent;

a needle control valve positioned in said injector body and including a poppet control valve member having a first position in which said needle control chamber is fluidly connected to said fuel inlet but closed to said needle control vent, and a second position in which said needle control chamber is closed to said fuel inlet but open to said needle control vent;

a needle valve positioned in said injector body and including a needle valve member with a closing hydraulic surface exposed to fluid pressure in said needle control chamber and an opening hydraulic surface exposed to fluid pressure in said nozzle chamber;

means, including a flow restriction in each fuel injector, for reducing fuel injector performance variations among said plurality of fuel injectors due to geometric variations in said needle control valves of said plurality of fuel injectors;

said poppet control valve member is a poppet valve member with an external surface with a first annular valve surface and a second annular valve surface;

said needle control valve defines a first flow area;

a pressure communication passage extending between said needle control valve and said needle control chamber includes said flow restriction that defines a second flow area that is smaller than said first flow area;

an electrical actuator positioned in said injector body and being operably coupled to said needle control valve;

wherein said electrical actuator is a solenoid with an armature attached to said poppet control valve member;

said injector body has a centerline;

said needle valve is positioned between said fuel inlet and said nozzle outlet along said centerline; and said first flow area has a size that is a function of a combined volume of said needle control chamber and said pressure communication passage.

9. A method of fuel injection, comprising the steps of:

relieving pressure on a closing hydraulic surface of a needle valve member at least in part by moving a poppet control valve member to a position that closes fluid communication between a common fuel rail and a needle control chamber; and resuming pressure on said closing hydraulic surface at least in part by moving said poppet control valve member to a position that opens fluid communication between said common fuel rail and said needle control chamber; and sizing a flow restriction area in a pressure communication passage extending between said poppet control valve member and said needle control chamber to be more restrictive than a flow area between a seat and said poppet control valve member;

sizing a flow restriction area in a pressure communication passage extending between said poppet valve member and said needle control chamber to be more restrictive than a flow area between a seat and said poppet control valve member; and sizing said pressure communication passage and said needle control chamber to have a combined volume less than about 50 cubic millimeters.

10. The method of claim 9 including a step of setting a travel distance of said poppet valve member to be less than about 50 microns.

* * * * *